US006065660A

United States Patent [19]

Cabrera

[11] Patent Number: 6,065,660

[45] Date of Patent: May 23, 2000

[54] TIN CAPS DISPENSER FOR NAIL GUN

[76] Inventor: Pedro Cabrera, 1745 W. 31 Pl., Hialeah, Fla. 33012

[21] Appl. No.: 09/273,158

[22] Filed: Mar. 19, 1999

[51] Int. Cl.[7] ..... B25C 7/00

[52] U.S. Cl. ..... 227/8; 227/18; 227/107; 227/130; 227/136

[58] Field of Search ..... 227/130, 8, 15, 227/16, 18, 114, 118, 135, 136, 137, 111, 120

[56] References Cited

U.S. PATENT DOCUMENTS

| | | | |
|---|---|---|---|
| 4,339,065 | 7/1982 | Haytayan | 227/120 |
| 5,042,142 | 8/1991 | Beach et al. | 227/111 |
| 5,193,729 | 3/1993 | Dewey et al. | 227/8 |
| 5,484,094 | 1/1996 | Gupta | 227/8 |
| 5,634,583 | 6/1997 | McGuinness et al. | 227/120 |
| 5,947,362 | 9/1999 | Omli | 227/120 |

*Primary Examiner*—Scott A. Smith
*Attorney, Agent, or Firm*—J. Sanchelima

[57] ABSTRACT

A tin cap dispenser for pneumatic nail guns that include a continues source of nails. The dispenser is also pneumatically activated and coupled to the operation of the nail gun. A pneumatically actuated handler arm member is reciprocally moved between two positions, one engaging a tin cap and the other one releasing it in alignment with a positioned nail also in coaxial alignment with the hammer of a nail gun. The timing of the tin cap handler arm member controls a valve assembly in series with the conventional trigger mechanism of the nail gun and another valve also in series that is activated by the handler arm member. A lock assembly inhibits the operation unless sufficient time is given to the feeding nails mechanism to get out of the way. The resulting device permits the continuous installation of tin caps on a flat surface.

2 Claims, 8 Drawing Sheets

TIN CAPS DISPENSER FOR NAIL GUN

BACKGROUND OF THE INVENTION

1. Field of the Invention

The present invention relates to system of tin caps dispenser for nail gun that makes the nail go through the tin cap center automatically avoiding quality problems, accidents, and saving time.

2. Description of the Related Art

There are several nail gun designs in the prior art but none of them include an automatic dispenser for tin caps, to the best of applicant's knowledge.

SUMMARY OF THE INVENTION

It is one of the main objects of the present invention to provide a dispenser for tin caps that cooperates with a nail gun to automatically place in proper location a tin cap in coordinated arrangement with the mechanism of a nail gun.

It is another object of this invention to provide a device that is safe to operate.

It is still another object of the present invention to provide a device that saves time.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
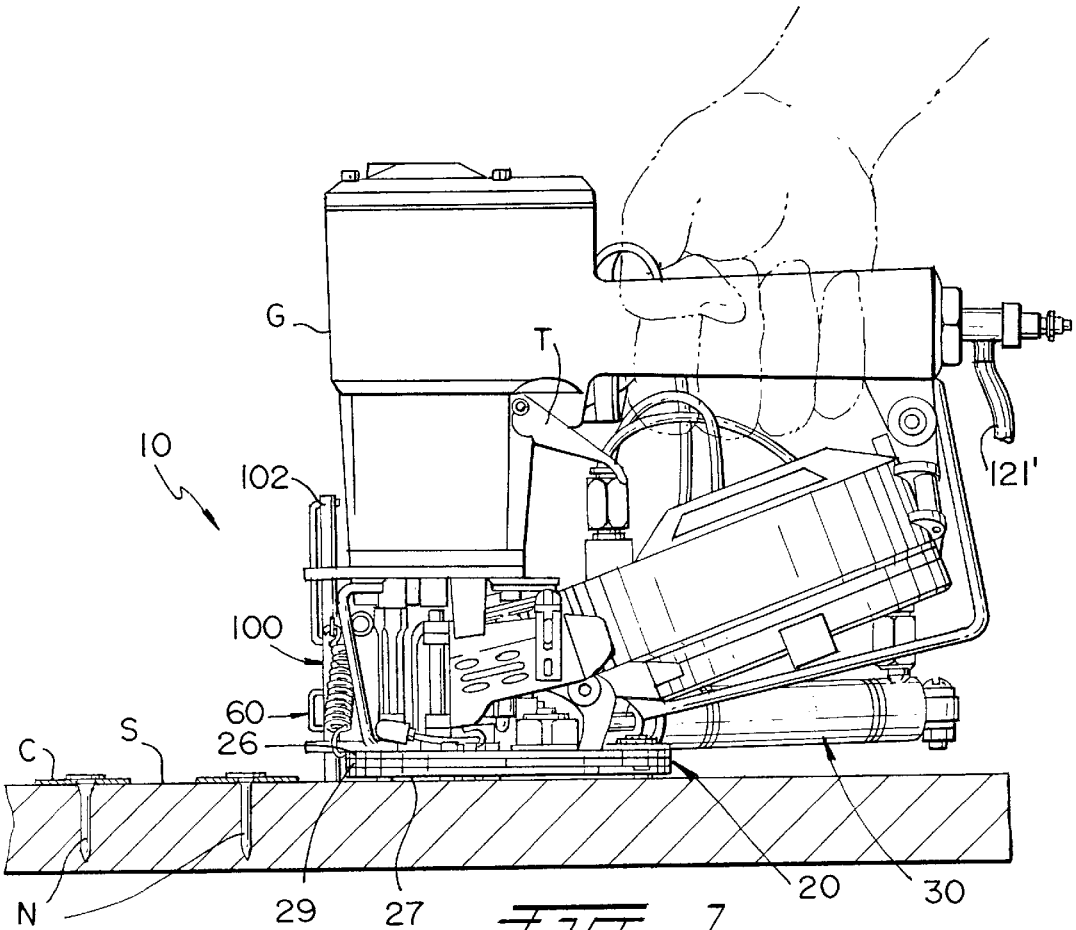
FIG. 1 is a representation of a gun nail G being used with one of the preferred embodiments of the present invention nailing tin caps C on surface S.

As seen in FIG. 1, a user operates a nail gun G to introduce nails N in a surface S, typically, piercing a tin cap C. Instead of manually positioning these tin caps C on surface S, the present invention 10 automatically positions them in safe coordination with the operation and mechanism of the gun G. Gun G includes trigger T that a user continuously presses while lifting and dropping gun G with the present invention. Gun G also includes a latch L for keeping nails N in.

Referring now to the drawings, where the present invention is generally referred to with numeral 10, it can be observed that it basically includes tin cap handler assembly 20, tin caps holder assembly 40 perpendicularly mounted thereon and adapted to urge the lowermost tin cap of a stack towards opening 24 above the surface being nailed. Safety lock assembly 60 prevents tin cap assembly from operating when hammer H of nail gun G is in a predetermined position.

Figure 2:
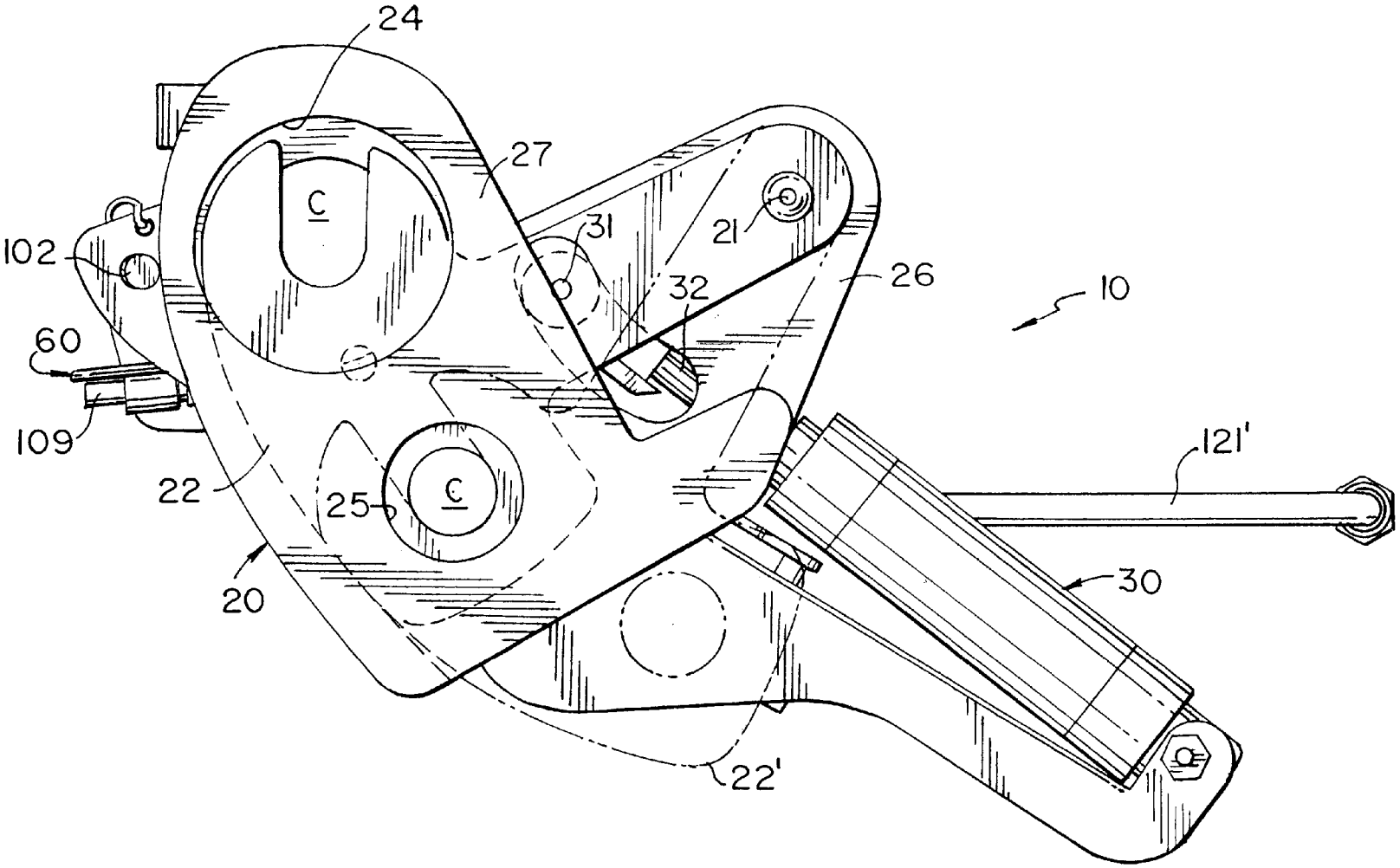
FIG. 2 represents a bottom view of the present invention showing tin caps C below the barrel of a nail gun G. The nail gun is not shown.
Figure 3:
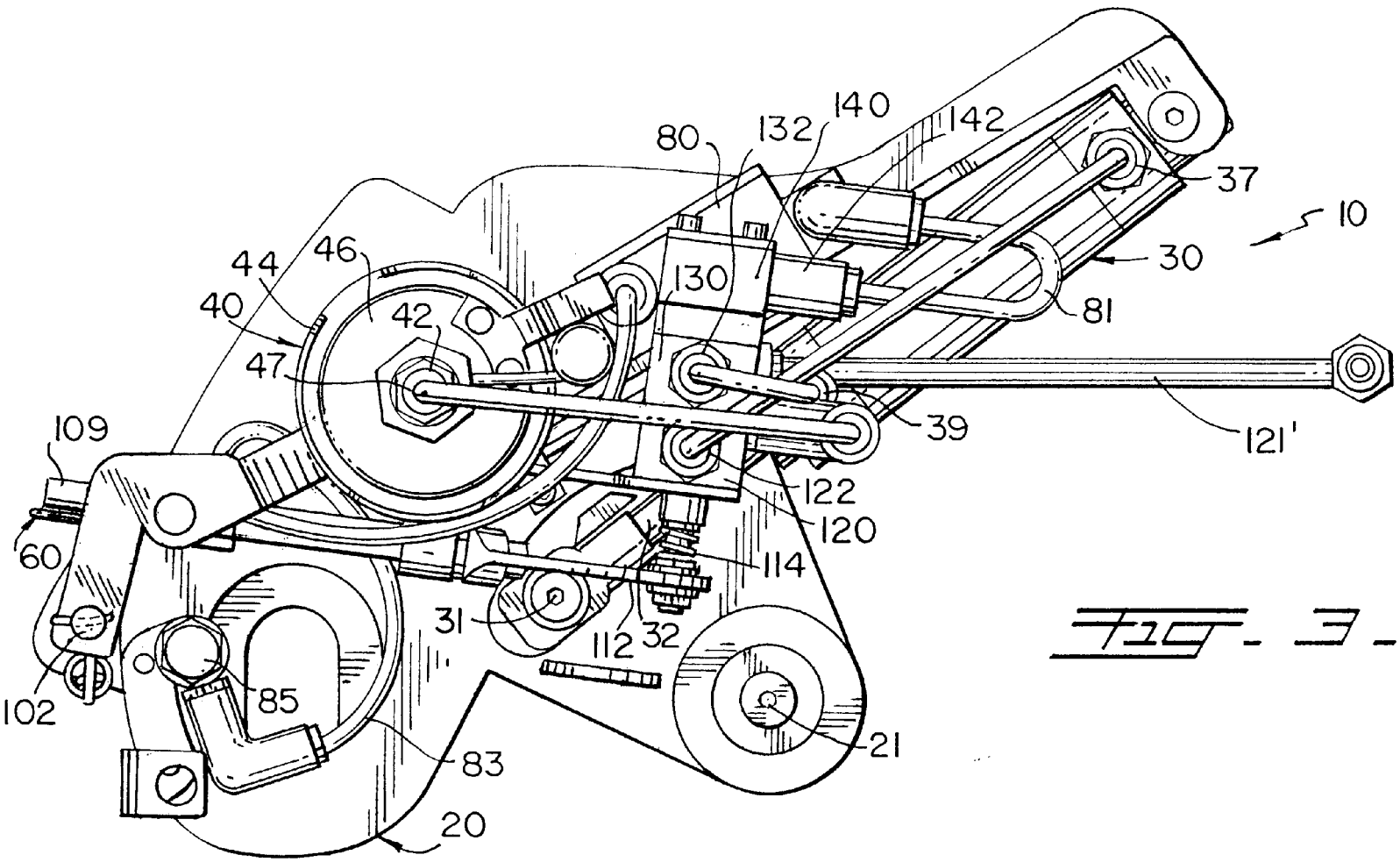
FIG. 3 shows a top view of the embodiment shown in FIG. 2.

FIG. 2 shows a bottom view of the preferred embodiment. It shows tin cap handler assembly 20 with handler arm member 22 in two extreme positions, one of them in solid lines and the other one in phantom referred to with numeral 22'. The solid lines position show member 22 positioning tin cap C. Handler arm member 22 is pivotally mounted to supporting plate 26 through pin 21. Member 22 is sandwiched between support plate 26 and bottom plate 27, separated by spacer 29 (shown in FIGS. 1 and 4). Member 22 is actuated by pneumatic cylinder assembly 30 through piston rod 32 which is pivotally mounted to pin 31 which in turn is rigidly mounted to member 22 at a separate point from pin 21. As seen in FIG. 3, cylinder assembly 30 includes ports 37 and 39 that permit the application of pressurized air to actuate its internal piston causing rod 32 to move from the extended position to the retracted position, selectively. The application of the pressurized fluid is controlled by valve assembly 120. The relationship of the states of valve 120 and handler arm member 22 can be best seen in the timing charts of FIGS. 8*a* through 8*h*.

Figure 5:
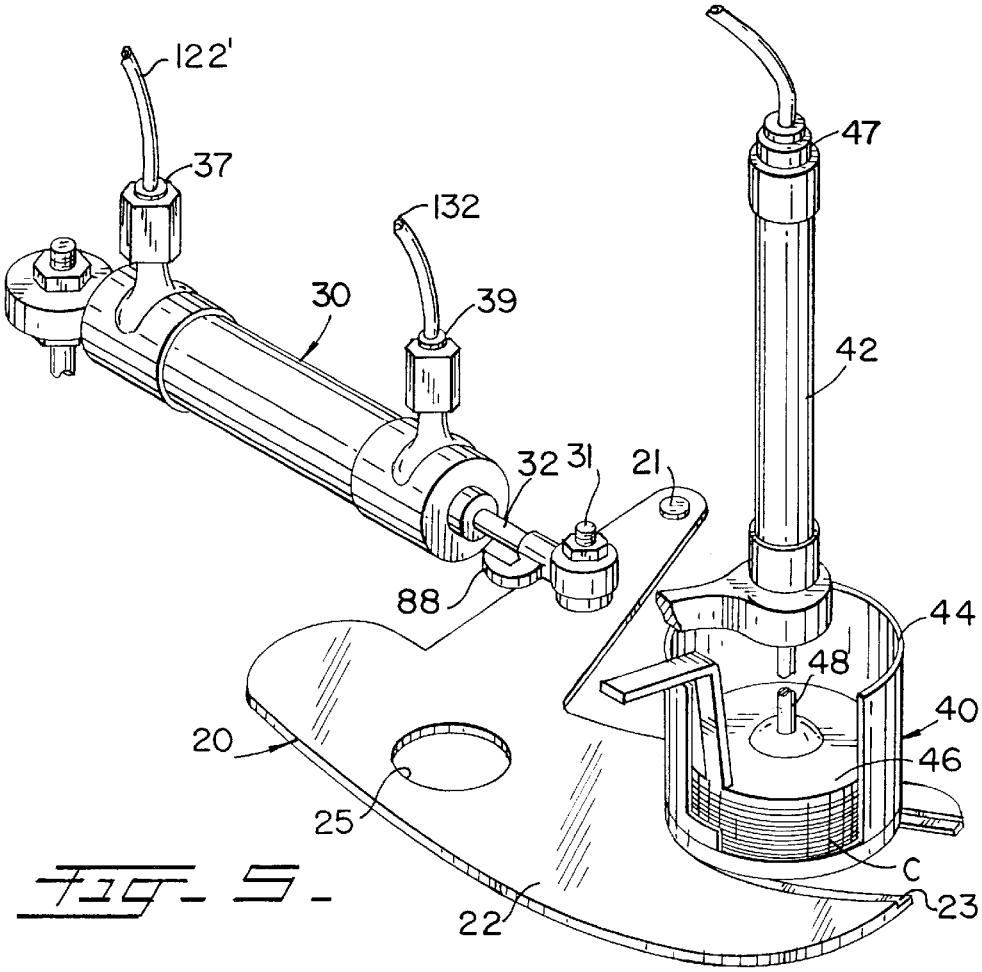
FIG. 5 is an isometric view of the tin caps handler member with actuating pneumatic cylinder and the tin caps holder by themselves.

Tin caps holder assembly 40 is perpendicularly mounted over opening 25 in plates 26 and 27 and it holds a predetermined number of tin caps C within arcuated wall 44, as seen in FIG. 3. Base 46 is mounted at the end of piston rod 48 to exert a predetermined amount of force against the stack of tin caps C as best seen in FIG. 5. Pneumatic cylinder 42 includes port 47 through which a predetermined pressure of air is applied to keep the stack with sufficient compression to urge the lowermost cap C against the inner surface of plate 27. In FIG. 5, the upper surface of arm member 22 can be observed to include curved recess wall 23 cooperatively shaped to receive the edge of tin cap C.

Figure 6:
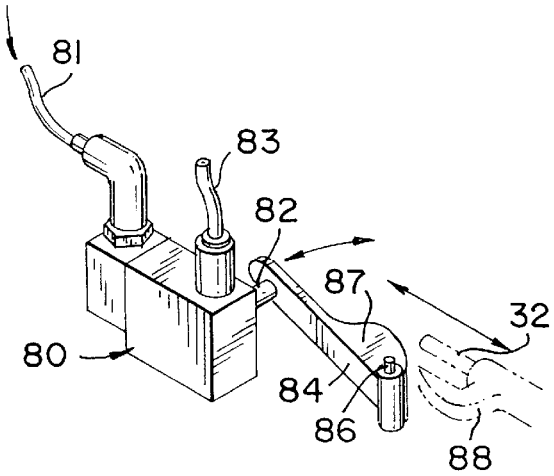
FIG. 6 is an isometric view of the valve assembly that activates hammer.
Figure 7:
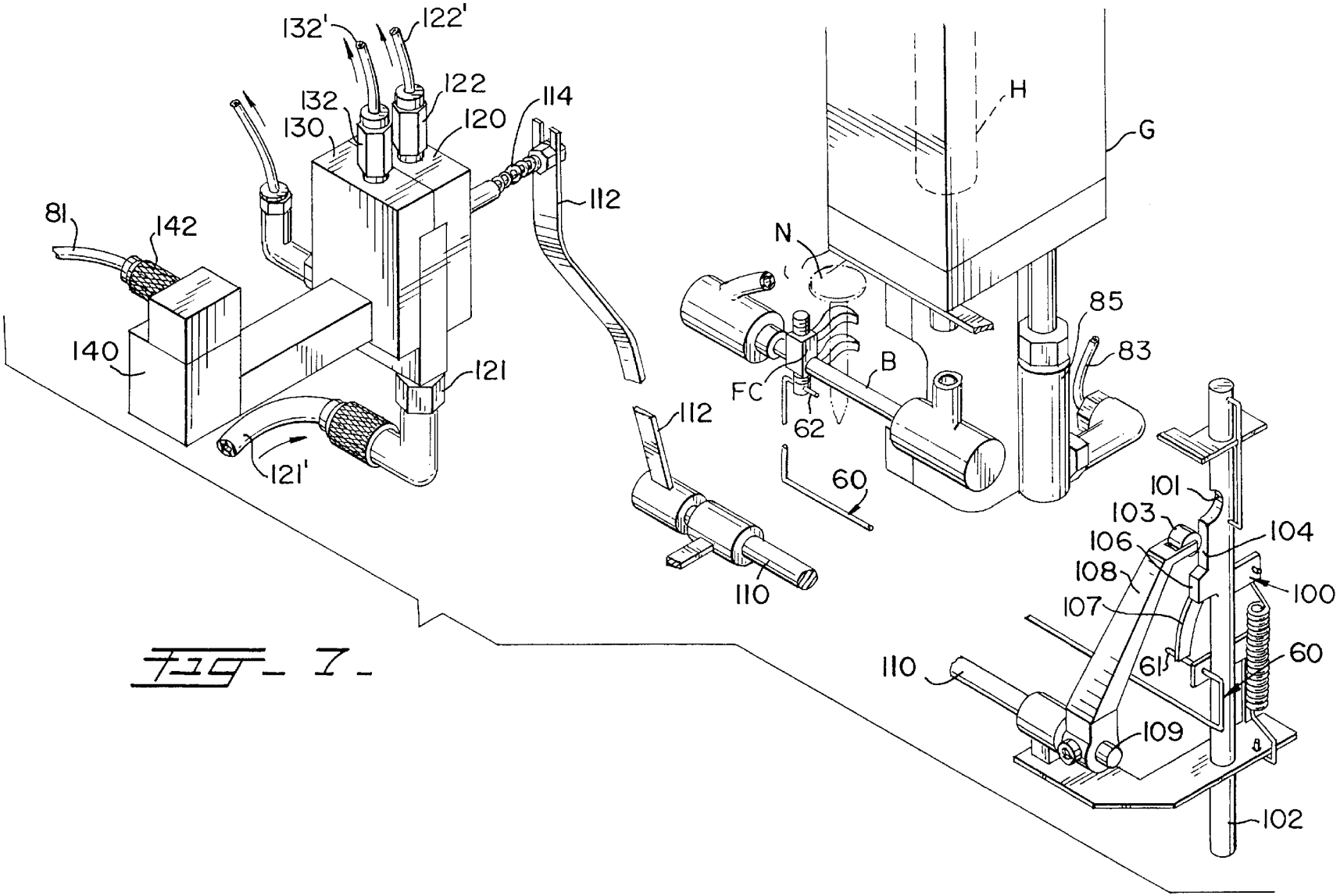
FIG. 7 is an isometric view of the trigger and valve assembly.

In FIG. 6, valve assembly 80 is shown with activator 82 being activated by lever 84 that is pivotally mounted at pivoting point 86, on one end. The other end of lever 84 includes cam surface 87 that cammingly coacts with curved finger 88 rigidly mounted on piston rod 32, as seen in FIG. 5. In this manner pressurized air enters through conduit 81 to valve assembly 80 and is permitted to go through valve assembly 80 and out through conduit 83, conduit 83 is connected to cylinder 85, as seen in FIG. 7, that permits hammer H be fired when handler arm member 22 is in position after the tin cap C has been properly placed. This ensures that the nail N is not fired until arm 22 is out of the way.

Figure 4:
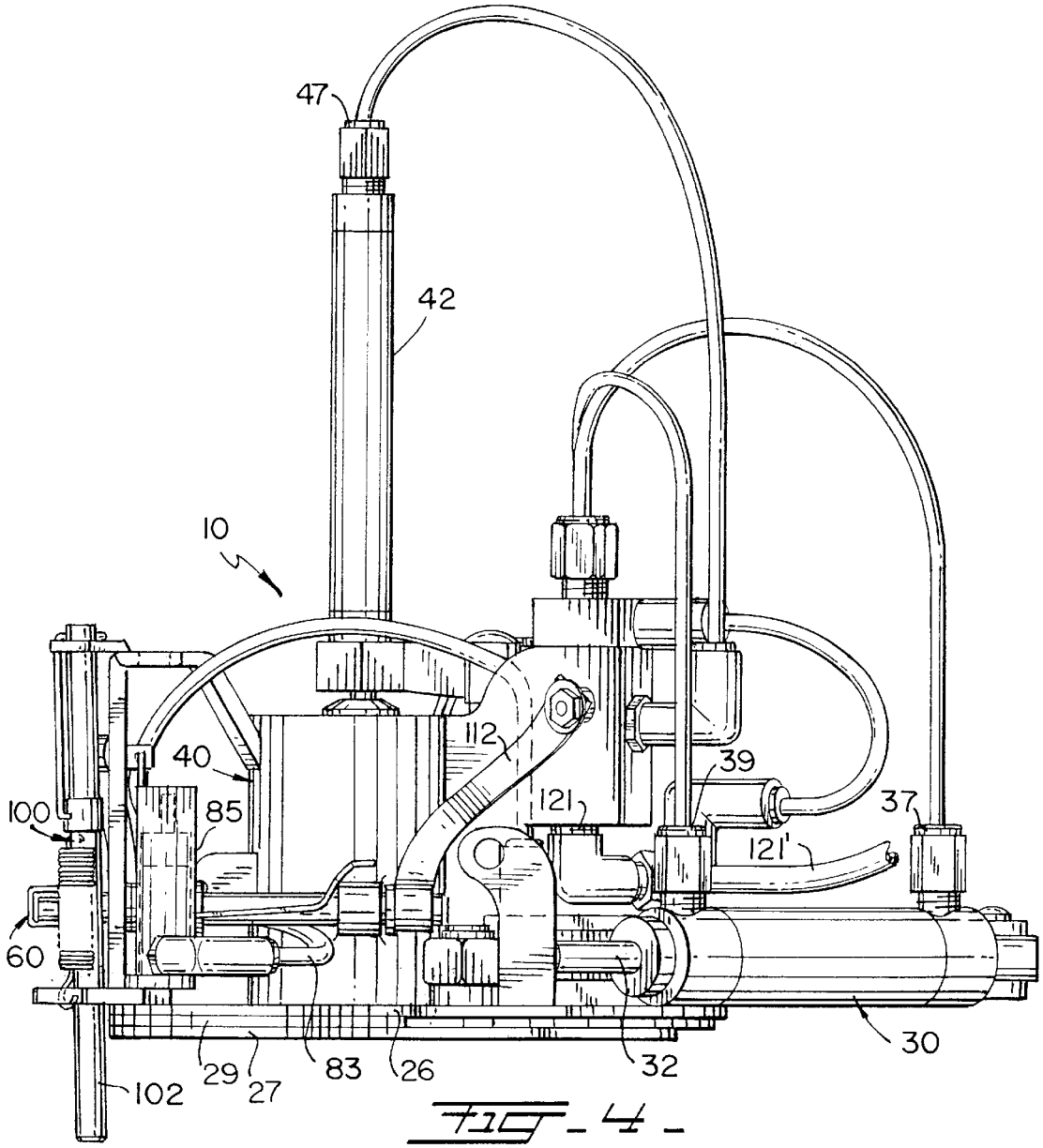
FIG. 4 illustrates a front elevational view of the nail dispenser showing the pneumatic feeding connection broken.

As shown in FIG. 4, surface trigger assembly 100 includes a vertically disposed trigger bar 102 that is spring biased to protrude downwardly beyond the plane of bottom plate 27. As seen in FIG. 7, bar 102 has two camming surfaces 104 and 106 that cause spring biased lever 108 to be cammingly moved about its pivoting point 109. Bar 102 has an at rest surface 101 when roller 103 at the distal end of lever 108 is lodged therein when gun G is separated from surface S and trigger bar 102 is pushed upwardly causing lever 108 to pivot a predetermined angular rotation causing the rotation of rod 110. Rod 110 has arm 112 rigidly and perpendicularly mounted thereon.

Arm 112 moves common valve actuator 114 to one of three positions, as best seen in FIG. 7. The first position is the at rest position when bar 102 is fully distended and roller 103 is lodged with cut-out 101. In the second position arm 112 moves a predetermined distance inwardly when rod 110 rotates as a result of roller 103 reaching camming surface 104. When at rest, the pressurized air applied to port 121 is available at port 122 of valve 120. When roller 103 is brought to the second area or surface 104, the pressurized air is no longer present at 122 and is available at port 132 of valve 130, thus bringing arm member 22 back to position 22'. When roller 103 is brought to surface 104, end 61 is in and prevents stopper leg 107 from advancing. When roller 103 reaches third area or surface 106 then the pressurized air is also made available to limit valve 140 at port 142 which in turn makes pressurized air available to conduit 81. As explained above, valve 80 needs to be activated by curved finger 88 actuating on cam surface 87. Thus, it is only when valve assembly 140 and valve assembly 80 are both activated that pressurized fluid is present at conduit 83 and hammer H is fired. Conduit 121' connects port 121 to gun C as shown in FIGS. 1, 2 and 3.

Safety lock assembly 60 is designed to ensure that handler arm member 22 does not interfere with hammer H. Coupled end 62 is connected to finger coupler FC found in most nail guns. Finger coupler FC is rigidly mounted to bar B which is also conventionally found in nail guns G and these components advance nails N to a position in cooperative coaxial alignment with hammer H. Thus, finger coupler FC can only be in two extremes positions, inside or outside. These two positions are used by safety lock assembly 60 to bring end stopper end 61 in and out. When end 61 is inside, it blocks the downwardly travel of trigger bar 102 and when end 61 is outside, there is no obstruction.

Figure 8A:
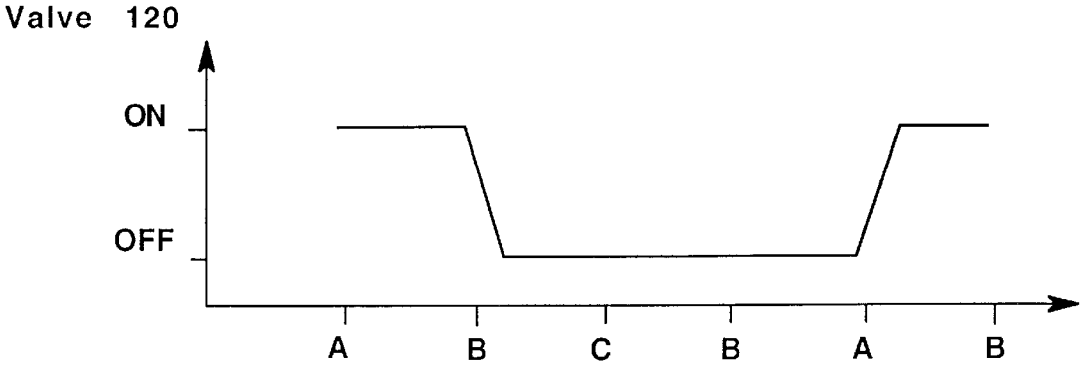
FIG. 8*a* represents a timing chart showing the different states of valve assembly 120 for different sequential positions of roller 103 as a user brings nail gun G to a surface S, with the gun trigger activated, and removes gun G. Event A is when roller 103 is at 101, for event B roller 103 is at 104 and for event C is at 106.

The timing chart represented in FIGS. 8*a;* 8*b;* 8*c;* 8*d*; 8*e;* 8*f;* 8*g;* and 8*h* shows the different events from the time prior to gun G coming in contact with surface S up to the end of the cycle when gun G is lifted.

Figure 8B:
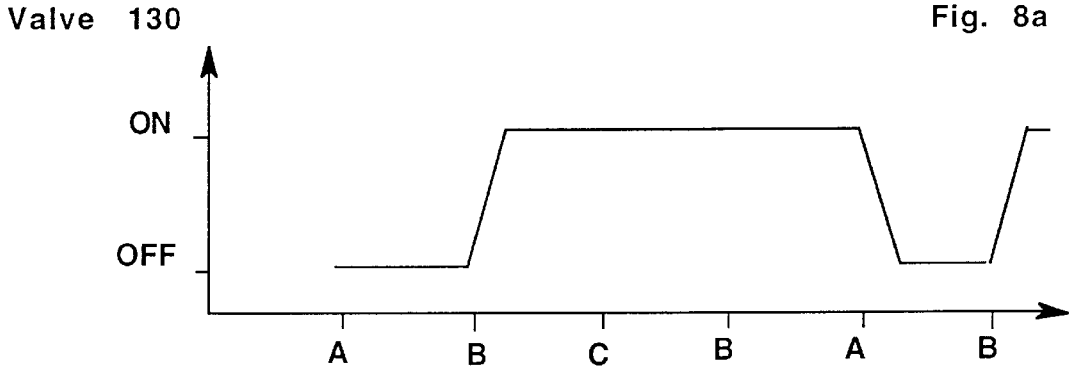
FIG. 8*b* is similar to the previous figure for valve assembly 130.
Figure 8C:
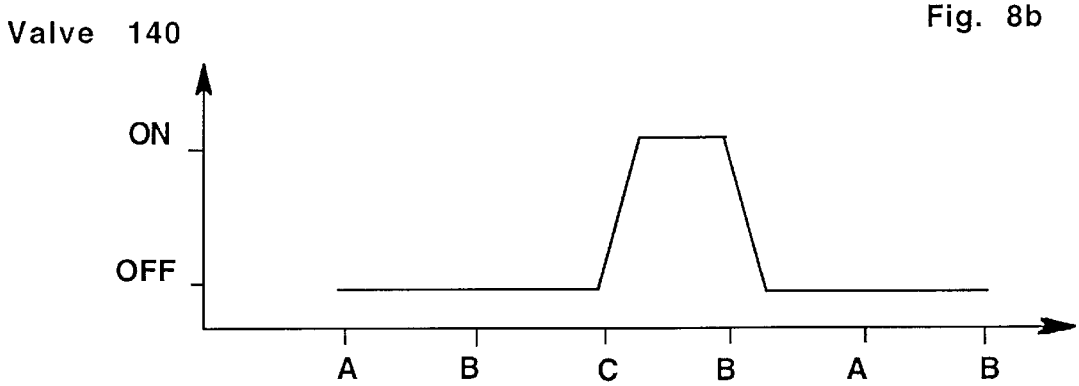
FIG. 8*c* is similar to the previous figure for valve assembly 140.
Figure 8D:
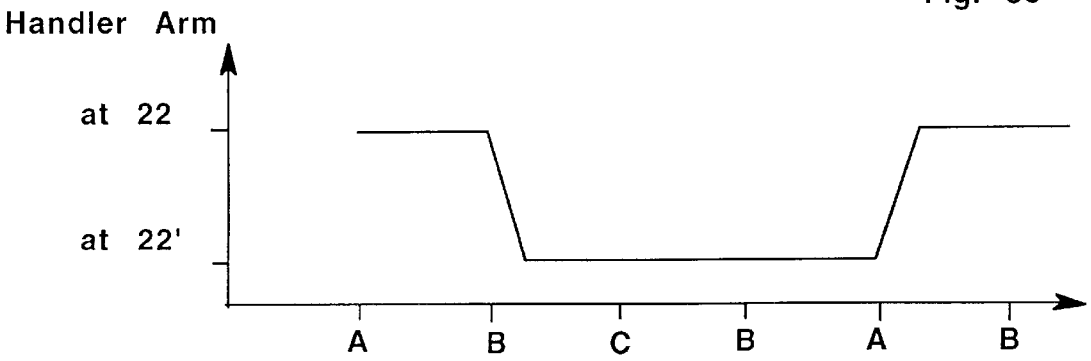
FIG. 8*d* shows the two extreme positions for handler arm member 22 and 22' with respect to events A; B and C.

When bar 102 of gun G is not making contact with surface S, roller 103 is against area 101 and this state is referred to as state or event "A" on the horizontal axis that represents time. When bar 102 makes contact with surface S and the force applied to the distal end of bar 102 urges it inwardly, roller 103 comes to area 104 and this is referred to as state or event "B". Finally, when the bottom of assembly 20 comes in abutting contact with surface S, ar 102 is urged to its innermost position and roller 103 is at 106. This is referred to as event "C". Subsequently, when a user starts lifting gun G, bar 102 starts moving outwardly at reaches event "B'" which is the same as event "B", except coming from the fully compressed position. One of the typical applications for the invention is using it to nail roof caps continuously. A user would do this task in repetition. FIGS. 8*a* through 8*c* show the states of valves 120; 130 and 140 during events A, B, C, B', A, B. The rising and falling edger are approximated to denote it is not instantaneous. Handler arm member 22 moves to position 22' when valve 120 is activated and valve 130 desactivated. For event "C" (roller 103 reaches area 106) valve 140 is activated which in turn pressurizes valve 80 (which is the other condition that needs to be satisfied before hammer H is fired) and stays pressurized while gun G is against surface S. Valve 80 then only needs to be activated by curved finger 88.

Figure 8E:
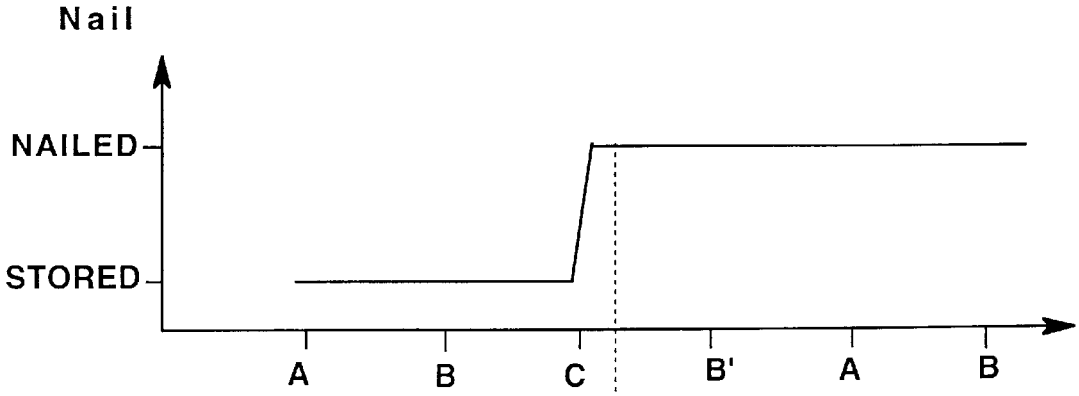
FIG. 8*e* shows the two states of a nail stored in the barrel (ready to be sent out) and after it was nailed.
Figure 8F:
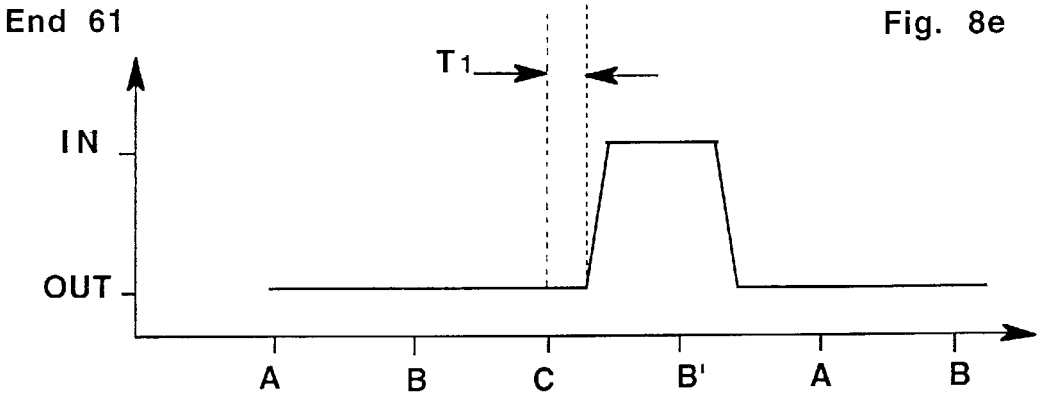
FIG. 8*f* shows the movement of end 61 (delayed by T1) of safety lock assembly 60.
Figure 8G:
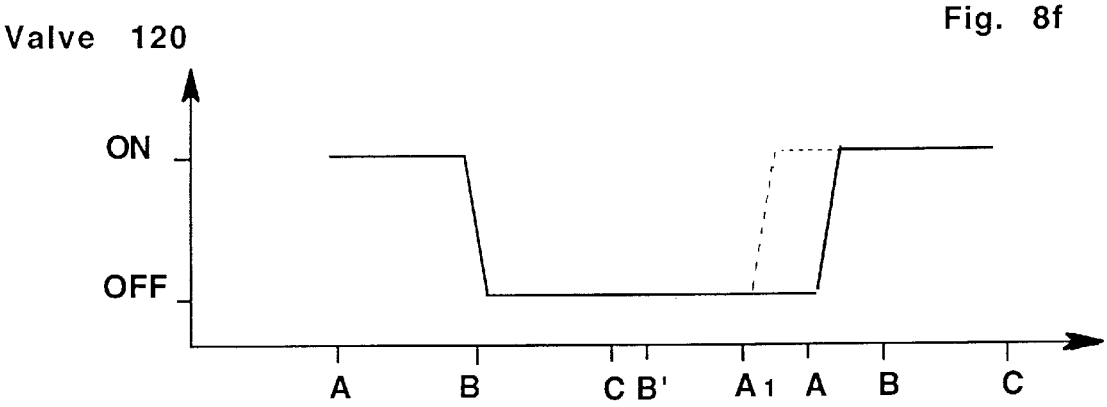
FIG. 8*g* shows event B' has been brought closer to event C (a user lifts gun G faster) and event A1 would have brought roller 103 to area 101.
Figure 8H:
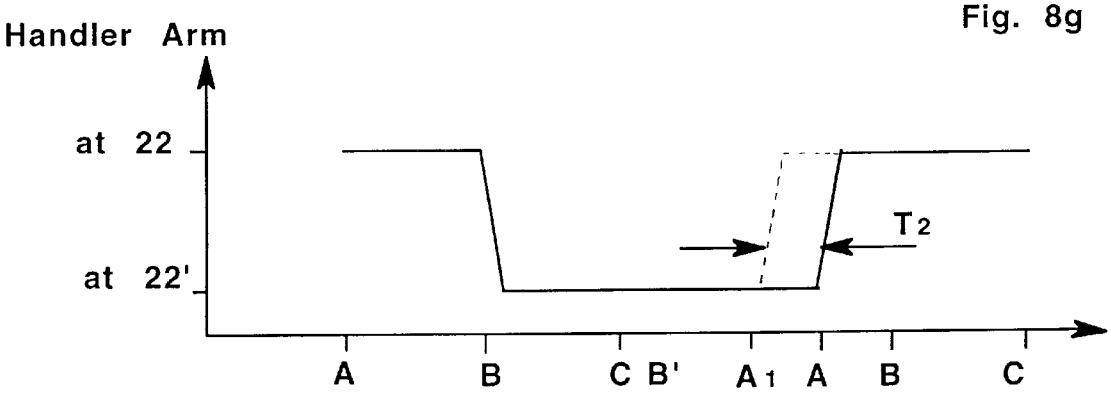
FIG. 8*h* shows member 22 (22') following valve assembly 120 and both delayed by time T2.

FIG. 8*e* shows the two states of a given nail stored in the barrel (ready to be sent out) and after it was nailed. This occurs on event "C". FIG. 8*f* shows the movement of end 61 (delayed by T1) of safety lock assembly 60 which blocks the possibility of bar 102 reaching a position where roller 103 would land on area 101 while end 61 is in. In FIG. 8*g* event B' has been brought closed to event C (a user lifts gun G faster) and event A1 would have brought roller 103 to area 101 as shown by the broken line had it not been for the blocking override of end 61 that does not permit bar 102 from protruding out completely until end 61 is out. In this manner, interference between hammer H and member 22 is avoided. FIG. 8*h* shows member 22 (22') following valve assembly 120 and both delayed by time T2.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A tin cap dispenser for a pneumatic nail gun connected to a source of a pressurized fluid and said nail gun having a barrel through which nails are forced out by a hammer upon activation by a user of a trigger including reciprocating means for feeding nails, comprising:

A) a supporting plate mounted to a nail gun perpendicular to said barrel and including first and second openings, said first opening being in cooperative alignment with said barrel;

B) a tin caps holder perpendicularly mounted on said supporting plate having a through passage for holding a plurality of tin caps and said passage having first and second ends, said first end being in cooperative alignment with said second opening;

C) a pneumatically actuated handler arm member pivotally mounted to said supporting plate and having a through aperture of substantially the same dimensions as said second opening and the first end of said passage so that said tin caps can pass through when said handler arm member is at a predetermined position and said handler arm member being movable to another position for cooperatively positioning a tin cap with respect to said first opening;

D) surface trigger means including a reciprocating spring biased bar mounted to said supporting plate having first, second and third contact surfaces said surface trigger means being connected in series with the trigger of a nail gun;

E) a spring biased roller assembly cooperatively biased against said trigger bar so that said roller assembly is always in one of said three contact surfaces, and the roller assembly being in contact with said first contact surface when said trigger bar is unobstructed and fully distended beyond the plane of said supporting plate, said roller passing through said second contact surface when said trigger bar is forced inwardly overcoming the spring bias of said trigger bar, and finally said roller assembly reaches said third contact surface when said trigger bar is pushed in by a flat surface in abutting relationship with said supporting plate;

F) first valve means for activating said handler arm member to one of said predetermined positions including first actuating means coupled to said roller assembly so that said first valve means is actuated when said roller assembly is in said first contact surface and not activated when it is away from said first contact surface;

G) second valve means for activating arm handler member to the other of said predetermined positions including second actuating means coupled to said roller assembly so that said second valve means permits pressurized fluid through when said roller assembly is in said second contact area and in said third contact area; and H) third valve means for passing through pressurized fluid to and outlet including third actuating means coupled to said roller assembly so that said third valve means permits said pressurized fluid to go through when said roller assembly is on said third contact surface; and I) fourth valve means connected to said outlet including fourth actuating means coupled to said handler arm member so that pressurized fluid present at said outlet is allowed through said fourth valve means when said handler arm member is in one of said predetermined positions.

2. The tin cap dispenser set forth in claim 1 further including:

J) means for locking said surface trigger means during a predetermined period of time, said means for locking said surface trigger means being mechanically coupled to the reciprocating means for feeding nails of a nail gun so that said trigger bar is prevented from moving to a predetermined position unless said reciprocating means is in a predetermined position.

* * * * *